US005392761A

United States Patent [19]

Swilik, Jr. et al.

[11] Patent Number: 5,392,761

[45] Date of Patent: Feb. 28, 1995

[54] BLOWER MOUNTING ARRANGEMENT FOR FORCED AIR FURNACE

[75] Inventors: Robert C. Swilik, Jr.; Scott A. Beck, both of Indianapolis, Ind.

[73] Assignee: Carrier Corporation, Syracuse, N.Y.

[21] Appl. No.: 108,924

[22] Filed: Aug. 18, 1993

[51] Int. Cl.[6] ..... F24H 3/00

[52] U.S. Cl. ..... 126/99 R; 126/110 A; 126/119; 417/423.1

[58] Field of Search ..... 126/99 R, 110 A, 106, 126/104 A, 114, 119, 116 R; 417/423.1

[56] References Cited

U.S. PATENT DOCUMENTS

| | | | |
|---|---|---|---|
| 2,263,098 | 11/1941 | Mueller | 126/114 X |
| 2,380,110 | 7/1945 | Huwer | 126/114 X |
| 2,464,473 | 3/1949 | Wessel | 126/114 X |
| 2,762,612 | 9/1956 | Druseikis | 126/116 R X |
| 3,382,862 | 5/1968 | Martz | 126/116 R X |
| 3,601,116 | 8/1971 | Davis | 126/110 |
| 4,092,088 | 5/1978 | Nemesi | 417/423.1 X |
| 5,060,722 | 10/1991 | Zdenek et al. | 126/99 R |

*Primary Examiner*—Larry Jones

[57] ABSTRACT

A forced air furnace has its blower mounted on a blower shelf beneath the heat exchanger, by screws that enter aligned clearance holes in the blower mounting flanges and blower shelf and which engage gripper holes in a bottom lip of the vertical cell panel that serves as the proximal wall of the furnace heat exchanger cell. This provides vertical support for the blower and absorbs stresses from up-and-down motion.

4 Claims, 3 Drawing Sheets

BLOWER MOUNTING ARRANGEMENT FOR FORCED AIR FURNACE

BACKGROUND OF THE INVENTION

The present invention is directed to a furnace that provides heated circulation air to an interior comfort space. The invention is more particularly concerned with a technique for mounting the circulation air blower onto a blower shelf of the furnace.

In a force air furnace, the circulation air blower is supported on a horizontal blower shelf beneath the heat exchanger cell. The blower or blowers can typically be a centrifugal blower in which a centrifugal rotor is mounted between blower side plates. The side plates can have flanges that engage flanges or lips on the side of the blower opening formed in the shelf. These lips provide at least some of the support for the blower. Typically, screws are used for mounting to the blower shelf, one on each side plate. These mounting screws pass through mounting flanges on the side plates and into the blower shelf. This arrangement does not provide a great deal of strength for vertical stresses, so it is coon to install shipping blocks around the blower to prevent stress damage during shipping of the furnace. These blocks are necessary to prevent stress cracks in the support shelf and the side plates during shipping. The shipping blocks increase the cost of the furnace, and require additional steps for the installer to remove and dispose of them.

Recently, multi-poise furnaces have been proposed, which can be installed in a normal, upflow configuration, an inverted, downflow configuration, a right flow horizontal configuration or a left flow horizontal configuration, whichever is most suitable to the particular housing unit or other structure. In such multi-poise furnaces the blower should be well supported both horizontally and vertically so that problems do not develop due to stress in operation. However, a conventional furnace, with the blower screwed into the blower shelf above, may not provide sufficient blower support, especially in the horizontal poises.

OBJECTS AND SUMMARY OF THE INVENTION

It is an object to increase the vertical support of a furnace circulation blower,I and to eliminate the need for shipping blocks for the blower.

It is another object to provide a multi-poise furnace with increased support for the circulation blower.

According to an aspect of the present invention, a forced air furnace is provided with a cabinet or casing within which a burner injects combustion gases into a heat exchanger. The heat exchanger is situated behind a cell panel that forms a proximal wall for the heat exchanger. Circulation air is received from a comfort space, e.g. the interior of a dwelling or commercial structure, into an intake side of the heat exchanger. The circulation air is heated and then is exhausted into a hot air supply plenum, from which it is distributed to the comfort space. A blower support shelf extends across the cabinet and serves as a partition to define a return air chamber or blower chamber beneath the heat exchanger. The blower shelf has a blower opening that serves as the intake of the heat exchanger, and one or more circulation blowers is supported on the shelf at the opening. The blower is typically a centrifugal blower with a rotor supported between a pair of side plates.

Each side plate has a mounting flange, and one or more openings are provided in the flange to accommodate a screw or similar fastener.

Rather than simply attaching the blower to the blower shelf, the screw passes through a clearance opening in the blower shelf and engages a gripper opening that is formed in a bottom lip of the vertical cell panel. The cell panel also has lips or flanges along its vertical side edges that are attached to side walls of the furnace cabinet. This system provides good support for the blower both vertically and horizontally. This attachment technique eliminates the need for blower-supporting shipping blocks by reducing the torsional stresses typically present on the blower shelf, casing and housing during shipping. The side supporting flanges of the vertical cell panel absorb the stresses caused by up-and-down motion during shipping.

The increased support supplied by the cell panel in combination with the blower shelf also reduces operating stresses that can occur if the furnace is installed in a horizontal, i.e., side-flow poise.

The above and many other objects features and advantages of this invention will become apparent from the ensuing description of a preferred embodiment, to be read in conjunction with the accompanying Drawing.

DETAILED DESCRIPTION OF THE PREFERRED EMBODIMENT

Figure 1:
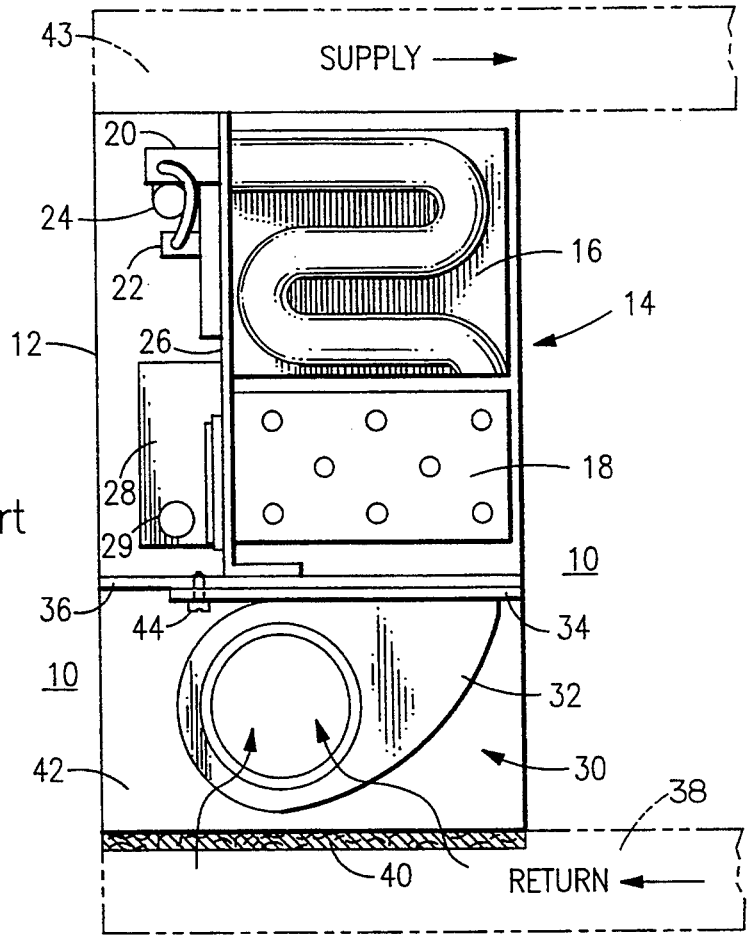
FIG.1 Prior Art
FIG. 1 is a schematic side elevation partly in section of a furnace having a blower mounted according to the prior art.
Figure 2:
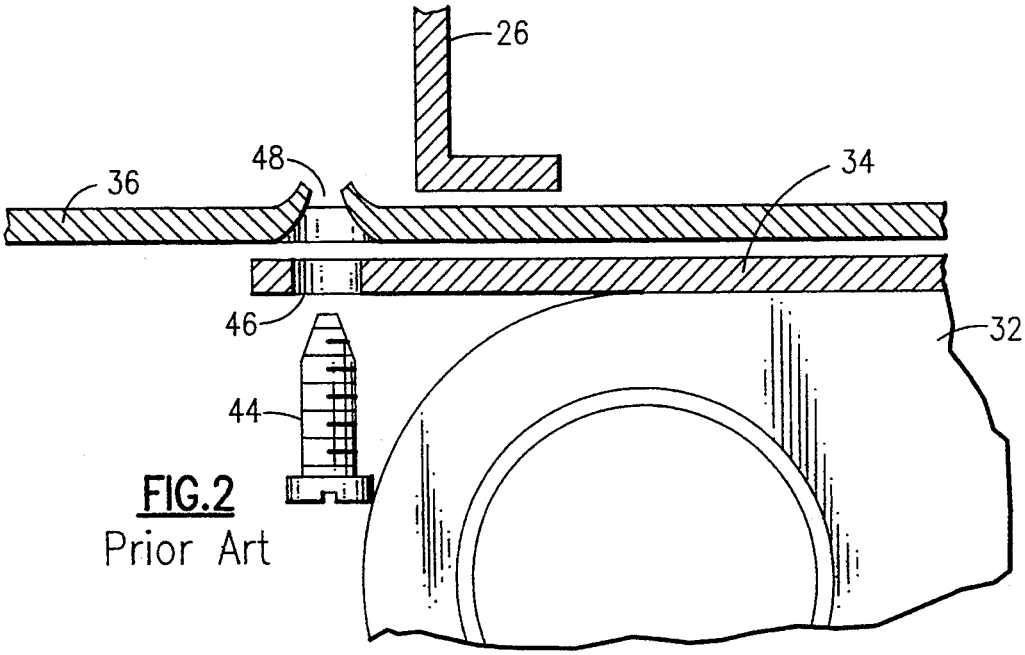
FIG.2 Prior Art
FIG. 2 is a detailed assembly view of the prior-art blower mounting of FIG. 1.

With reference to the Drawing, FIGS. 1 and 2 illustrate a conventional mounting technique for a circulation blower and is offered to help emphasize the advantages of the present invention. As shown here, a forced air furnace 10 configured in a normal, upflow mode has a cabinet 12 or enclosure containing a heat exchanger cell 14 that consists of a primary heat exchanger stage 16 and a secondary heat exchanger stage 18 which can be of the condenser type. A burner box 20 which contains a row of gas burners is positioned at an inlet to the primary stage 16. A gas valve 22 and a combustion air intake 24 are shown for supplying a fuel gas and combustion air respectively to the burners. These are supported on a vertical cell panel 26 that extends across the cabinet and defines a proximal wall of the heat exchanger cell 14. The secondary heat exchanger 18 exhausts the combustion gases to an inducer fan 28 that discharges the gases to an exhaust vent 29.

A circulation air blower 30 is positioned below the heat exchanger cell 14 and here is of the centrifugal design.

The blower 30 has a shell or volute of which a side plate 32 is shown here. A similar side plate is disposed on the other side of the blower 30. Each of the side plates 32 has a mounting flange 34.

A blower shelf 36 extends horizontally across the cabinet 12 beneath the heat exchanger cell 14 and has an opening for the blower, this opening serving as an intake for the heat exchanger 14. The blower 30 is mounted onto the blower support shelf as described shortly below. Beneath the cabinet 12 a return duct 38 brings circulation air from a comfort space through an air filter 40 to a blower chamber 42 defined between the filter 40 and the shelf 36. The shelf here serves as a partition to define the chamber 42. Above the heat exchanger cell 14, heated air proceeds to a plenum 43 from which it is distributed back to the comfort space.

As shown in FIG. 2, the blower 30 is attached to the shelf 36 by means of mounting screws 44. Each screw passes through a clearance hole 46 in the blower flange 34 and engages a gripper hole 48 in the blower support shelf 36.

It should be immediately apparent that this fastener arrangement does not provide vertical support to absorb up and down motion of the blower. This can place a high strain on the blower and on the shelf, especially during transit. Therefore, shipping blocks have to be installed to brace the blower 30 against the stresses expected during shipping. These blocks also have to be removed by the installer when the furnace is installed.

Figure 3:
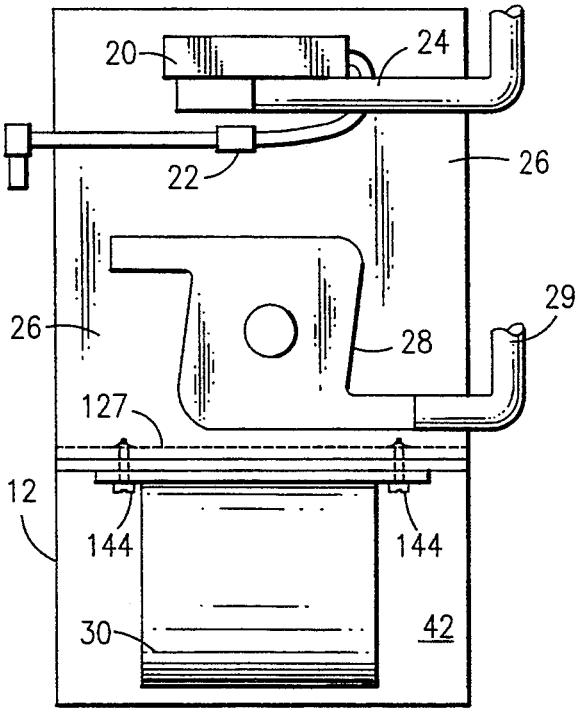
FIGS. 3 and 4 are front and side elevations showing a furnace having a blower mounted according to one embodiment of this invention.
Figure 4:
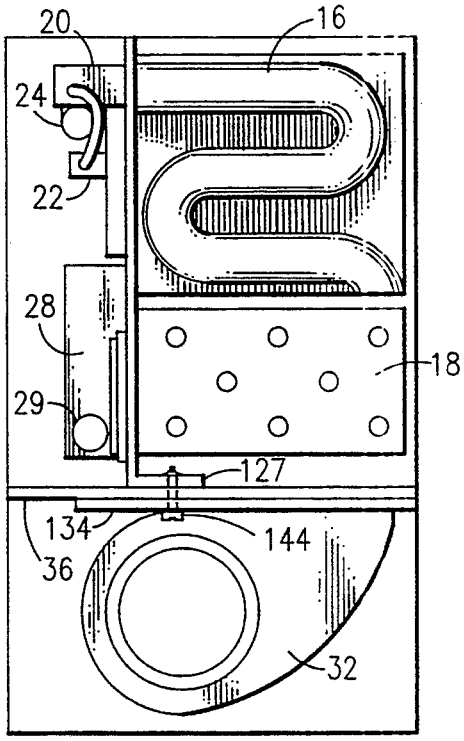
Figure 5:
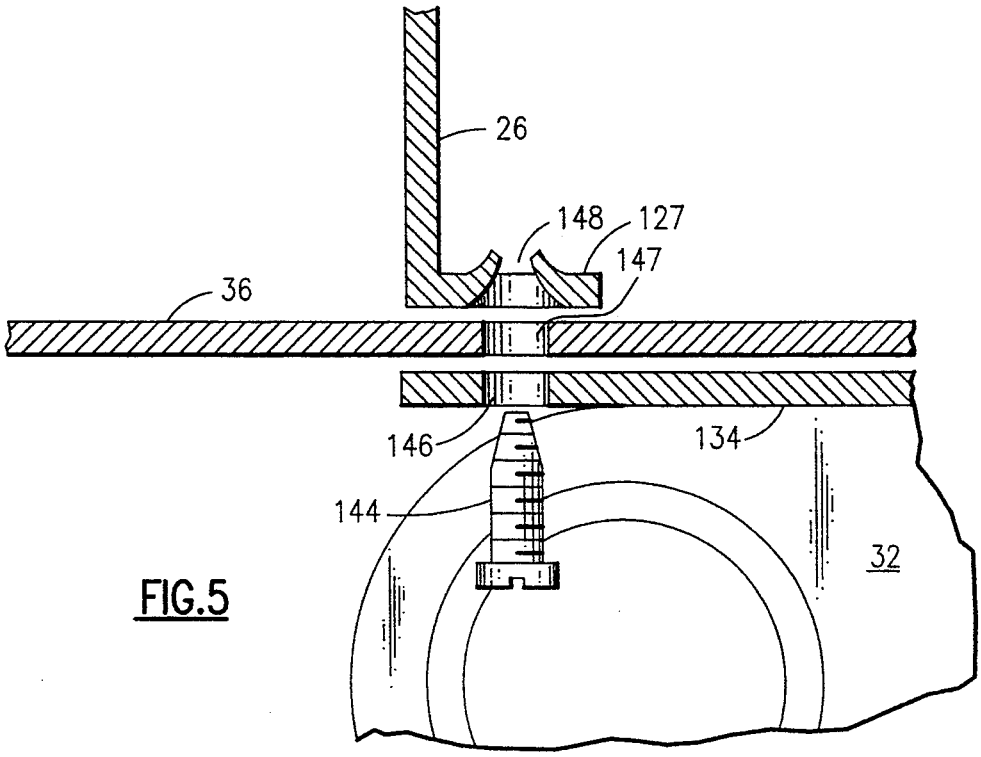
FIG. 5 is a partial sectional view showing details of this embodiment.

An embodiment incorporating the improvement of this invention is shown in FIGS. 3, 4 and 5. Elements that are identical with those of FIGS. 1 and 2 are identified with the same reference numbers and a detailed description of those elements is omitted. The improvement features employ similar reference numbers, but raised by 100.

FIG. 3 is a front view of the furnace 10 with cover removed showing the burner box 20, intake pipe 24, gas valve 22, inducer 28 and exhaust vent pipe 29 mounted in relation to the vertical cell panel 26. FIG. 3 also shows the blower 30, situated in the chamber 42, and mounted on the blower shelf 36. In this embodiment the blower 30 is supported on a transverse lip or flange 127 of the vertical cell panel 26, as shown in FIG. 4 and in more detail in FIG. 5. Here the blower side plates 32 each have a flange 134 with at least one clearance hole 146. A clearance hole 147 is provided in the shelf 36 in registry with the hole 146, and a gripper hole 148 is formed in the lip 127 in registry with the two associated clearance holes 146, 147. A screw 144 or other equivalent fastener passes through the holes 146, 147 and engages the gripper hole 148, so that the blower support flange 134 is attached firmly to the vertical cell panel 26, with the blower shelf 36 sandwiched between them.

Figure 6:
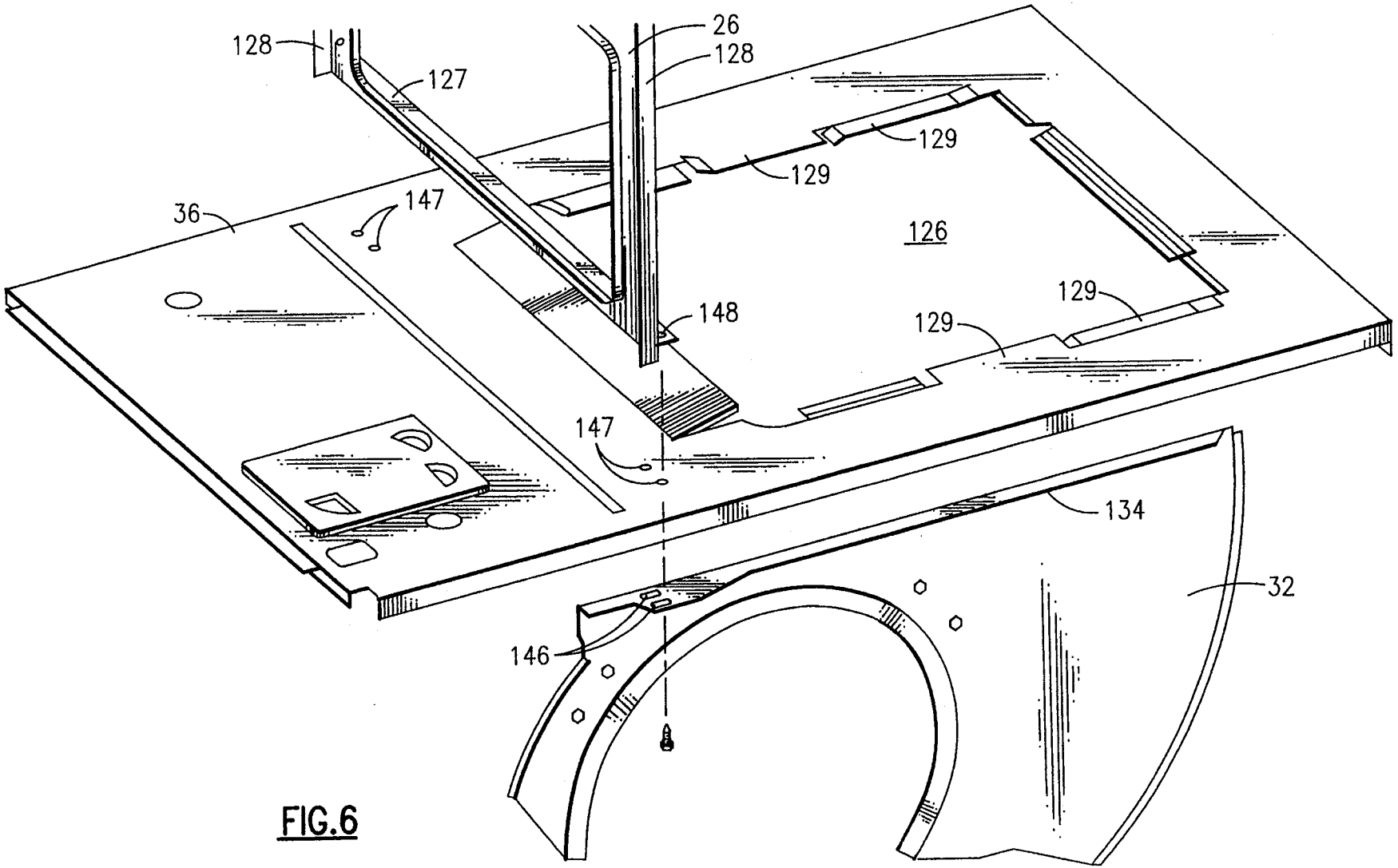
FIG. 6 is a partial assembly view showing details of this embodiment.

FIG. 6 shows specific details of selected elements, namely the cell panel 26, the blower shelf 36 and one of the blower side plates 32. As shown here the vertical cell panel has the lower lip or flange 127 formed at its base or bottom edge to rest on the shelf 36, and also has left and right reinforcing lips 128, 128 that provide vertical support to the cell panel 26. These engage side support structure (not shown) on side walls of the cabinet 12. The side support structure run parallel with the mounting screws 144 and help absorb stresses from up and down motion of shipping. The side supports are generally in line with, i.e. not offset from the position of the blower mounting screws 144. Thus the side supports also eliminate torsional stress from the blower shelf 36.

In this embodiment for each side plate 32 the respective flange 134 has a pair of clearance holes 146, the shelf has two corresponding pairs of clearance holes 147 and the lip has two pairs of gripper holes 148. Thus two pairs of screws 144 are employed to mount the blower 30. In other embodiments, there are only one set of holes 146, 147 on each side.

Also shown in FIG. 5 is the blower opening 126 formed in the shelf 36, the opening serving as the return air intake port for the heat exchanger 14. Here there are engaging flanges 129 along the sides of the opening. These support the laterally protruding side flanges 134 of the side plates 32 which slidably enter the flanges 129. The flanges 134 continue along the top edge of the respective side plate 32 from the position of the mounting screws 144.

In this embodiment the blower flange 134, the blower support shelf 36 and the vertical cell panel 26 combine to give good vertical and transverse support to the blower. This means that stresses from shipping are avoided and special shipping support blocks can be eliminated. It also means that the blower is well supported in horizontal as well as vertical poises of the furnace.

In an alternative embodiment (not shown) the screws 144 are installed from above passing through clearance holes in the transverse cell panel flange 127 and in the blower shelf 36, to engage gripper holes in the blower flanges 34.

This invention has been described here with reference to a single embodiment. However, many modifications and variations thereof would become apparent to these skilled in the art without departing from the scope and spirit of this invention as defined in the appended claims.

We claim:

1. Forced air furnace comprising a cabinet, a heat exchanger within said cabinet having a circulation air intake to receive return air from a comfort space and a circulation air discharge from which heated circulation air flows to be supplied to said comfort space, a horizontal blower support shelf extending beneath said heat exchanger across said cabinet and having a blower opening that serves as said circulation air intake for said heat exchanger; the blower support shelf serving as a partition defining a return air chamber beneath it within said cabinet; a circulation air blower mounted on said blower support shelf within said return air chamber to move said circulation air through said blower opening into said heat exchanger; said blower including a mounting flange with an opening therein to receive a fastener device; a vertical cell panel within said cabinet above said blower support shelf serving as a proximal wall of said heat exchanger, and having a transverse lip at a lower edge that rests upon said blower support shelf; and burner means on said cell panel for discharging heat into said heat exchanger for heating said circulation air therein; wherein said blower mounting flange and said vertical cell panel transverse lip are disposed in registry with each other with said horizontal blower support shelf therebetween, and said fastener device passes through said blower mounting flange and said blower support shelf into said lip so that the blower is supported by said vertical cell panel.

2. Forced air furnace according to claim 1 wherein said blower flange and said blower support panel have clearance holes in registry with one another, and said cell panel lip has a gripper hole formed in registry with said clearance holes to receive a threaded fastener device therein.

3. Forced air furnace according to claim 1 wherein said blower has a pair of vertical blower side plates each having a laterally protruding flange extending along an upper edge, continuous with said blower support flange; and said blower support shelf has engaging flanges along side edges of said blower opening into which the laterally protruding flanges respectively slide.

4. Forced air furnace according to claim 1 wherein said vertical cell panel has lips along its vertical side edges, the lips being supported on side walls of said cabinet.

* * * * *